US010019022B2

(12) United States Patent
Hu et al.

(10) Patent No.: US 10,019,022 B2
(45) Date of Patent: Jul. 10, 2018

(54) LEVEL SHIFTING MODULE AND POWER CIRCUIT AND METHOD OF OPERATING LEVEL SHIFTING MODULE

(71) Applicant: M2Communication Inc., Hsinchu County (TW)

(72) Inventors: Chia-Chi Hu, Hsinchu County (TW); Hung-Ta Tso, Hsinchu County (TW); Chun-Yi Lee, Hsinchu County (TW); Derrick Wei, Hsinchu County (TW)

(73) Assignee: M2Communication Inc. (TW)

( * ) Notice: Subject to any disclaimer, the term of this patent is extended or adjusted under 35 U.S.C. 154(b) by 235 days.

(21) Appl. No.: 15/095,557

(22) Filed: Apr. 11, 2016

(65) Prior Publication Data

US 2017/0293312 A1 Oct. 12, 2017

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC . G05F 1/56; G05F 1/575; G05F 1/465; G05F 1/468; G05F 1/462; G05F 1/565; G05F 1/567; H02M 2001/0045
See application file for complete search history.

(56) References Cited

U.S. PATENT DOCUMENTS

2014/0042998 A1* 2/2014 Saito ..... G05F 1/468 323/271

* cited by examiner

*Primary Examiner* — Adolf Berhane
*Assistant Examiner* — Afework Demisse
(74) *Attorney, Agent, or Firm* — Volpe and Koenig, P.C.

(57) ABSTRACT

A power circuit includes a first regulator and an impedance adjustment unit. The first regulator has a loop-back impedance, and provides a first power signal. The impedance adjustment unit is coupled to the first regulator, and operates to cause the first regulator to provide a second power signal having a power level different from that of the first power signal.

7 Claims, 6 Drawing Sheets

LEVEL SHIFTING MODULE AND POWER CIRCUIT AND METHOD OF OPERATING LEVEL SHIFTING MODULE

TECHNICAL FIELD

Embodiments of the present disclosure are related to a level shifting module, and more particularly to a level shifting module and a power circuit and method of operating the level shifting module.

BACKGROUND

In coming years, portable devices, node sensors, battery-based electronic devices and billions of these devices will overwhelm the world and crowd with our daily life. The major concern regarding the electronic devices is about the power consumption and battery life. Power management can improve the chip's power efficiency so as to prolong the battery life and operating time. A system-on-chip consumes less power, and the sustained system lifetime will inevitably grow rapidly. A power saving mode, also called a sleep mode, is a common design approach to achieve a longer system lifetime.

Please refer to FIG. 1, which shows a system-on-chip 10 in the prior art. The system-on-chip 10 is powered by a power circuit, such as low drop-out (LDO) regulator 12. The LDO regulator 12 is powered by a battery having a voltage of 3.3 volts, and outputs a digital supply voltage to the system-on-chip 10. The system-on-chip 10 will be switched to the sleep mode when users temporarily do not need system services, but it will be switched back to the active mode when users do. During the sleep mode, the digital supply voltage provided from the LDO regulator 12 may be lowered by at least 20%, for example, from 1.2 volts to 0.9 volt as shown in FIG. 1, it indicates the system-on-chip 10 consumes 20% less power in the sleep mode compared with a normal mode.

Please refer to FIG. 2, which shows a single LDO regulator 12 operated in different modes in the prior art. The LDO regulator 12 provides the system-on-chip 10 with 1.2 volts in the normal mode, and can switch to 0.9 volt in the sleep mode. However, in fact, we need a high current capacity LDO in the normal mode, while needing a low current capacity LDO in the sleep mode Thus, it is not practical to build a single LDO to fulfil the two-end requirement, it is better to build LDO pairs.

Please refer to FIG. 3, which shows multi-level LDO regulators 11 and 13 in the prior art. For the sake of power-saving, by means of lowering the digital supply voltage, the LDO regulator 11 in a high level state can support high capacity and precision in the normal mode, the LDO regulator 13 in a low level state can support low quiescent current in the sleep mode. However, this conventional structure of a power circuit needs switches 15, 16 for each LDO regulator 11, 13 respectively, and the digital supply voltage needs to be switched between the two LDO regulators 11, 13 via switches 15, 16. When the system 14 is in the normal mode, the switches 15 and 17 conduct, and the switches 16 and 18 are cut off. The digital supply voltage may suffer from some glitches at the time the switch 15 conducts and the switch 16 is cut off, while the operations of the switches 17, 18 almost do not affect the digital supply voltage which is regulated by the LDO regulators 11, 13. Consequently, any switches arranged in the path between the LDO regulators 11, 13, may result serious glitches, and those glitches cause difficult system control issues. Thus, it is better not to have any switches along the path. Furthermore, by defining the voltage range of each LDO properly, the switchless transition can be seamless.

On the other end, for about the 5-year-life-time system powered by the battery, according to energy estimates, the digital supply voltage level needs to be aggressively lowered under the sleep mode. However, the system 14 may run under a low voltage, but a low voltage may result in a system wake-up failure. For the failure scenario, just before waking up, the digital supply voltage tends to be switched back; a level shifter 19 will receive a first signal Si having a voltage level as low as the digital supply voltage, and transform it into a second signal S2 having another level as high as the battery voltage to control the LDO regulator 11. However, not all the level shifters 19 can operate in such a wide-range supply level gap between the above low voltage level and the high voltage level if the voltage level difference is very large. The unsuccessful low-to-high translation of the level shifter 19 may result in a system failure to wake-up due to an inaccurate control signal after the level translation. Normally, a standard level will work under the 0.9 volt digital supply voltage typically, but under 0.7 volt, it will not work.

For a certain system power requirement, when the system 14 operates in the sleep mode, a standard level shifter cannot function at such a low digital supply voltage, so a specially-design level shifter may be required in order to fulfill its function. Thus, in the prior way to build an application-specific level shifter with wide operating voltage range, it may cause inefficiencies including low speed, large area, high power consumption, high cost and inefficiency of design, and these contradict our basic system assumptions which cannot be compromised.

Therefore, it is expected that different power sources can be adopted in different modes to provide the system with optimal power without switches there between, and it is also expected that a method and a device can solve the issue, a low-power system operating under wide-range supply level

SUMMARY OF EXEMPLARY EMBODIMENTS

In accordance with one embodiment of the present disclosure, a level shifting module is disclosed. The level shifting module used with a digital circuit which generates a first power signal in an idle mode, comprises a first low drop-out (LDO) power circuit, a level shift unit and a second LDO power circuit. The LDO power circuit is electrically connected to the digital circuit, receives the first power signal having a first power level, and outputs a second power signal having a second power level to the digital circuit, wherein the second power level is higher than the first power level. The level shift unit is electrically connected to the digital circuit, receiving the second power signal, and outputs a third power signal, wherein the third power level has a third power level higher than the first power level, and the first power level is insufficient to allow the level shift unit to convert the first power level to the third power level. The second LDO power circuit is electrically connected to the first LDO power circuit and the digital circuit, and receives the third power signal to activate and power the digital circuit under an active mode.

In accordance with one embodiment of the present disclosure, a method of operating a level shifting module is disclosed. The method of operating a level shifting module including a level shift unit, a first power circuit and a second power circuit used with a system, the method comprising steps of: upon receiving a wake-up signal having a wake-up power level from the system, providing the system with a first power signal having a first power level higher than the wake-up power level; generating a second power signal having a second power level in response to the first power signal; outputting a third power signal to activate the second power circuit under an active mode in response to the second power signal, wherein the wake-up power level is insufficient to drive the level shift unit, and the second power level is higher than the wake-up power level in order to drive the level shift unit.

In accordance with a further embodiment of the present disclosure, the present invention discloses a power circuit. The power circuit comprises a first regulator and an impedance adjustment unit. The first regulator has a loop-back impedance, and provides a first power signal. The impedance adjustment unit is coupled to the first regulator, and operates to cause the first regulator to provide a second power signal having a power level different from that of the first power signal The above embodiments and advantages of the present invention will become more readily apparent to those ordinarily skilled in the art after reviewing the following detailed descriptions and accompanying drawings.

DETAILED DESCRIPTION OF THE PREFERRED EMBODIMENTS

Figure 1:
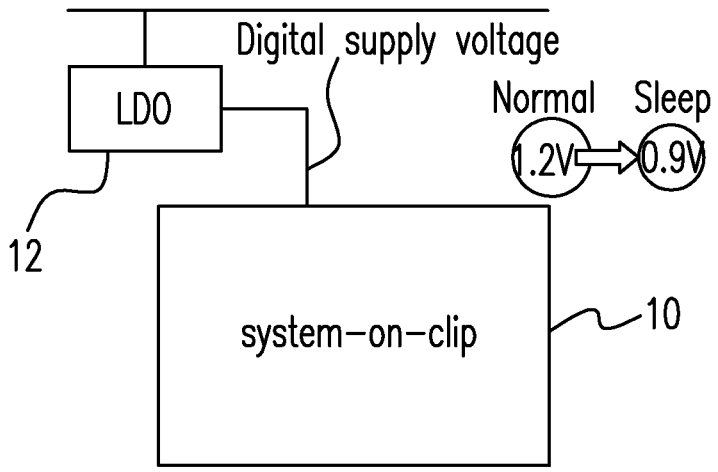
Fig. 1(Prior Art)
FIG. 1 shows a system-on-chip in the prior art.
Figure 2:
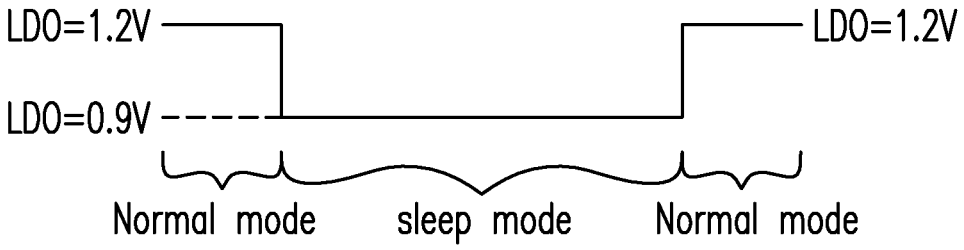
Fig. 2(Prior Art)
FIG. 2 shows a single LDO regulator operated in different mode in the prior art.
Figure 3:
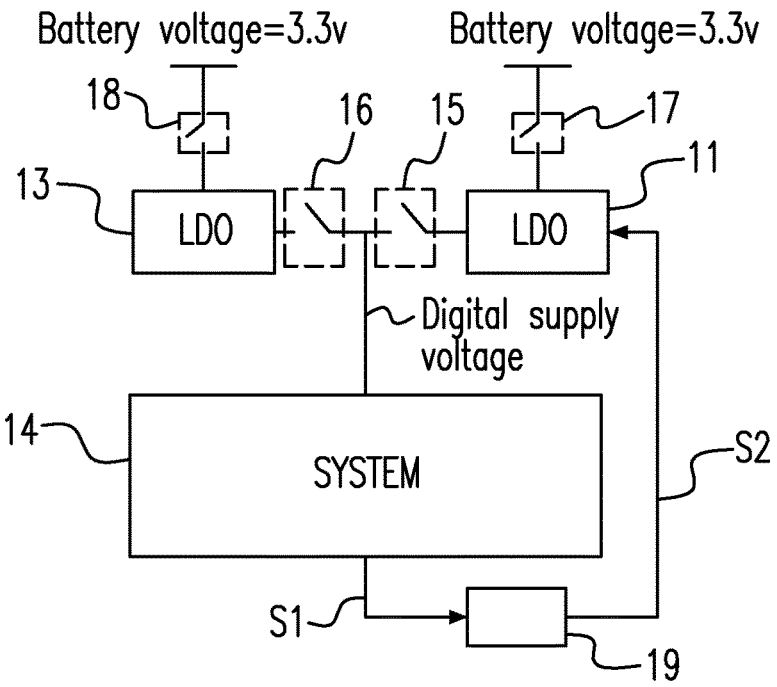
Fig. 3(Prior Art)
FIG. 3 shows multi-level LDO regulators in the prior art.
Figure 4:
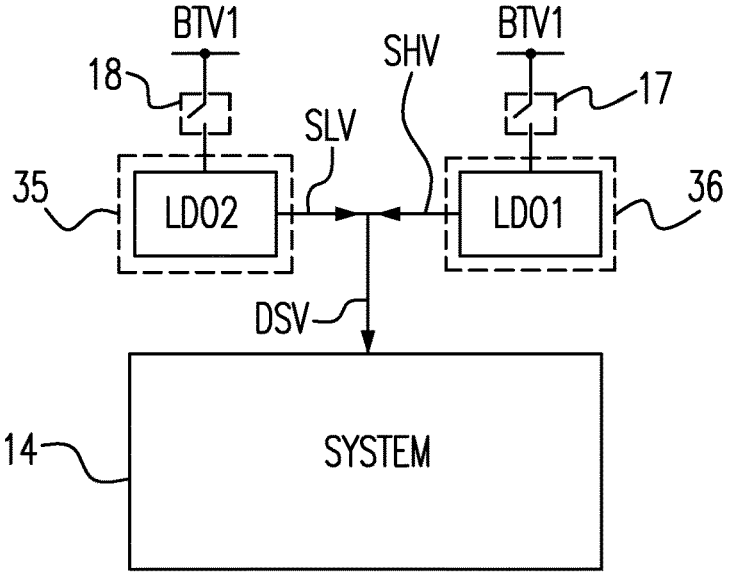
FIG. 4 shows a system powered by two power circuits without any switch therebetween according to the preferred embodiment of the present disclosure.

Please refer to FIG. 4, which shows the system 14 powered by two power circuits 35 and 36 without any switch therebetween according to the preferred embodiment of the present disclosure. The power circuits 35 and 36 respectively include or are regulators LDO1 and LDO2. For example, the regulators LDO1 and LDO2 are two LDO regulators. Please compare FIGS. 3 and 4, there are no switches 15, 16 between the regulators LDO1, LDO2 and the system 14. The system 14 is electrically connected to the regulators LDO1 and LDO2. A power signal DSV from at least one of the regulators LDO1 and LDO2 supplies the system 14 with the optimal power level. For example, it is only the regulator LDO1 that provides the system 14 with the power signal SHV having a high level voltage when the system 14 operates in the normal mode, and typically the high level voltage is in the range of 0.9~1.2 volts; while it is only the regulator LDO2 that provides the system 14 with the power signal SLV having a low level voltage when the system 14 operates in the idle mode, and typically the low level voltage is in the range of 0.07~0.9 volts. Although the regulators LDO1 and LDO2 are electrically connected together without any switch, even the two regulators LDO1 and LDO2 supply the power signals SHV, SLV to the system 14 simultaneously, this will not cause a short circuit to burn them out or damage them because each of the two regulators LDO1 and LDO2 can tolerate a small voltage difference and can withstand a small range of voltage swing resulting from noise, glitches, etc. For example, during the time the system 14 begins to switch from the normal mode to the idle mode, switches 17 and 18 coupled to the battery may conduct at the same time, and the battery provides each of the regulators LDO1 and LDO2 with a battery voltage BTV1. Therefore, the two regulators LDO1 and LDO2 supply power to the system 14 simultaneously and the two power signals SHV and SLV have the voltage difference (1.2-0.7=) 0.5 volt in the worst case. For the sake of tolerance, the regulator LDO1 can withstand a voltage difference of 0.5 volt, and vice versa. In some embodiments, the switch 18 can be omitted and the regulator LDO2 is always supplied by the battery voltage BTV1 because the regulator LDO2 has a little capacity and consumes very low power.

In some embodiments, when the system 14 operates in the normal mode, the switch 17 conducts, the switch 18 is cut off, and thus a power signal DSV supplying to the system 14 is equal to the power signal SHV. When the system 14 operates in the idle mode, the switch 17 is cut off, the switch 18 conducts, and thus the power signal DSV supplying the system 14 is equal to the power signal SLV.

Figure 5:
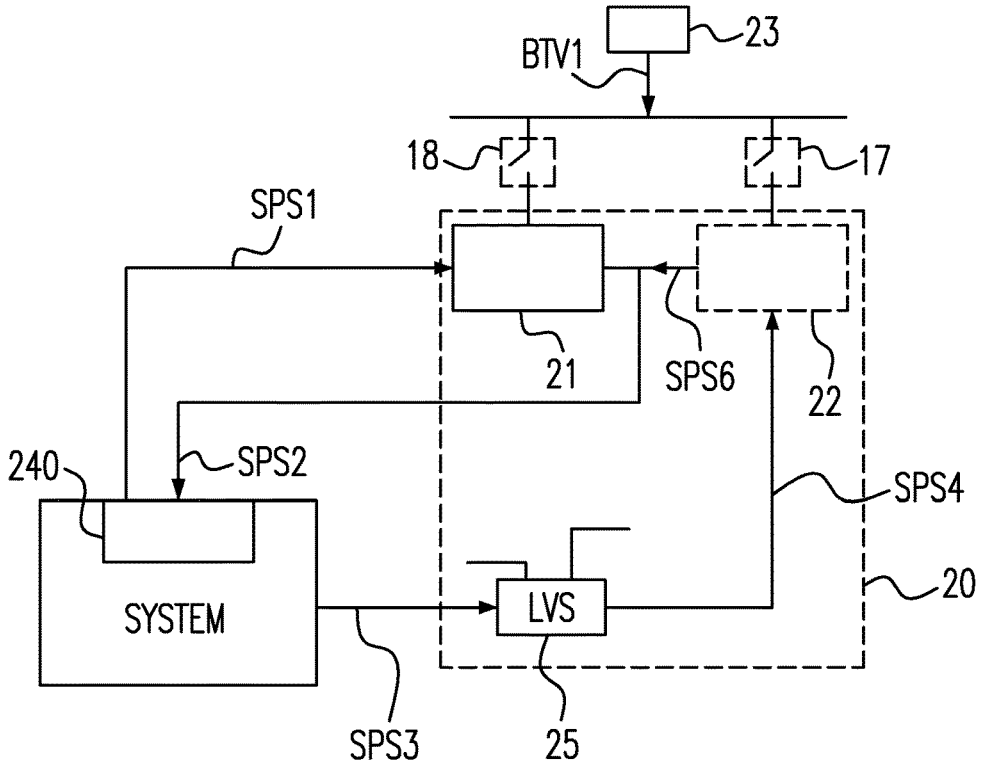
FIG. 5 shows a level shifting module according to the preferred embodiment of the present disclosure.

Please refer to FIG. 5, which shows a level shifting module 20 according to the preferred embodiment of the present disclosure. The level shifting module 20 is used with the system 24 including a digital circuit 240 which can generate a first power signal SPS1 in the idle mode. The level shifting module 20 includes LDO power circuits 21 and 22, and a level shift unit 25. In FIG. 5, the LDO power circuit 21 is electrically connected to the digital circuit 240, receives the first power signal SPS1 having a first power level, and outputs a second power signal SPS2 having a second power level to the digital circuit 240, wherein the second power level is higher than the first power level. The digital circuit 240 outputs a third power signal SPS3 having a third power level in response to receiving the second power signal SPS2. The level shift unit 25 is electrically connected to the digital circuit 240, receives the third power signal SPS3, and outputs a fourth power signal SPS4 having a fourth power level, wherein the third power level is higher than the first power level, and the first power level is insufficient to allow the level shift unit 25 to convert the first power level into the fourth power level. The LDO power circuit 22 is electrically connected to the first LDO power circuit 21 and the digital circuit 240, and receives the fourth power signal SPS4 to activate and power the digital circuit 240 under an active mode. Finally, the LDO power circuit 22 is active and supplies the system 24 with the power signal SPS6 which has a fifth power level being higher than the second power level.

In FIG. 5, LDO power circuits 21 and 22 operate simultaneously without switches disposed between the system 24 and LDO power circuits 21 and 22, whenever in the idle mode or the active mode. The LDO power circuit 21 is only turned on in the idle mode by the switch 18, the LDO power circuit 22 is only turned on in the active mode by the switch 17. Because the LDO power circuit 21 is specially designed, the first level can be converted into the second level. When the system is powered by the second level, it outputs the third level, which is sufficient to allow the level shift unit 25 to convert, and the third level is no less than the second level.

The fourth power signal SPS4 has a voltage higher than that of the third power signal SPS3. For example, the third level is 1.2 volts and the fourth level is 3.3 volts after a level conversion of the level shift 25.

Figure 6:
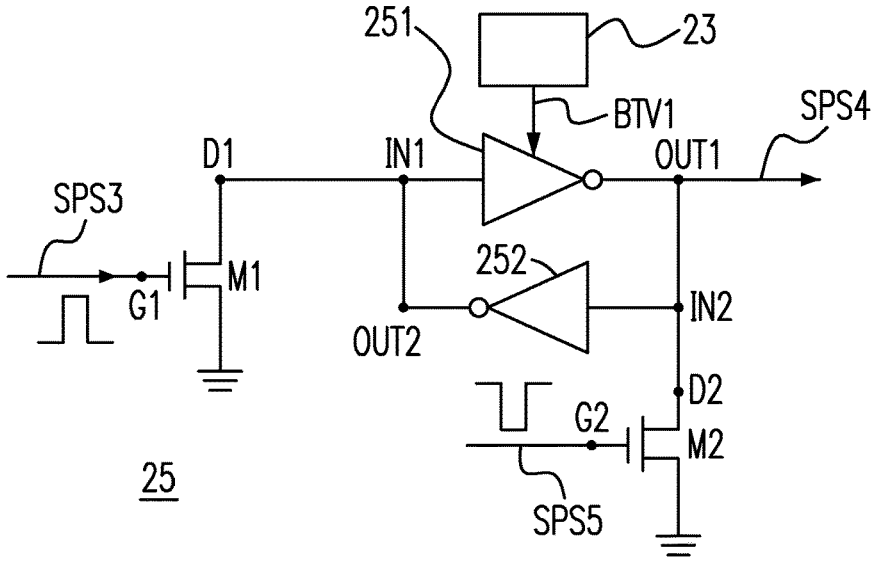
FIG. 6 shows the level shift unit in detail according to the preferred embodiment of the present disclosure.

Please refer to FIG. 6, which shows the level shift unit 25 in detail according to the preferred embodiment of the present disclosure. The level shift unit 25 can convert the third power level into the fourth power level being higher than the third power level. For example, converting from a low voltage level of 1.2 volts to a high voltage level of 3.3 volts. The system 24 may provide the level shift unit 25 with the third power level the same as the second power level. The level shift unit 25 includes a first inverter 251, a second inverter 252, a first NMOS unit M1 and a second NMOS unit M2. The first inverter 251 is powered by a battery unit 23, has a first input terminal IN1 and a first output terminal OUT1 and outputs the fourth power signal SPS4. The second inverter 252 is powered by the battery unit 23, has a second input terminal IN2 and a second output terminal OUT2, wherein the first input terminal IN1 is electrically connected to the second output terminal OUT2 and the first output terminal OUT1 is electrically connected to the second input terminal IN2. The first NMOS unit M1 has a first drain terminal D1 electrically connected to the first input terminal IN1, and has a first gate terminal G1 receiving the third power signal SPS3. The second NMOS unit M2 has a second drain terminal D2 electrically connected to the second input terminal IN2, and has a second gate terminal G2 receiving a fifth power signal SPSS, and the fifth power signal SPSS has an opposite logic level compared with that of the third power signal SPS3.

In some embodiments, the system 24 can provide both the third power signal SPS3 and the fifth power signal SPSS, the third level can be for example 0.7~1.2 volts depending on how low a voltage the level shift unit 25 can accept, and the opposite logic level is logic "0", indicating 0 volts. The battery voltage BTV1 of the battery unit 23 is the same as the fourth power level, for example, is typically equal to 3.3 volts. In some embodiments, the level shift unit 25 may further include a third inverter (not shown) to convert the third power signal SPS3 into the fifth power signal SPSS, while the third inverter is supplied with the third power level.

In FIG. 6, when the third power signal SPS3 has a high level state and the fourth power signal has a low level state, the first NMOS unit M1 conducts, the second NMOS unit M2 is cut off, causing a first voltage level at the first input terminal IN1 to be decreased, a second voltage level at the first output terminal OUT1 is converted into the fourth power level by the first inverter 251, and the first inverter 251 outputs the fourth power signal having the fourth power level as the battery voltage BTV1.

Figure 7:
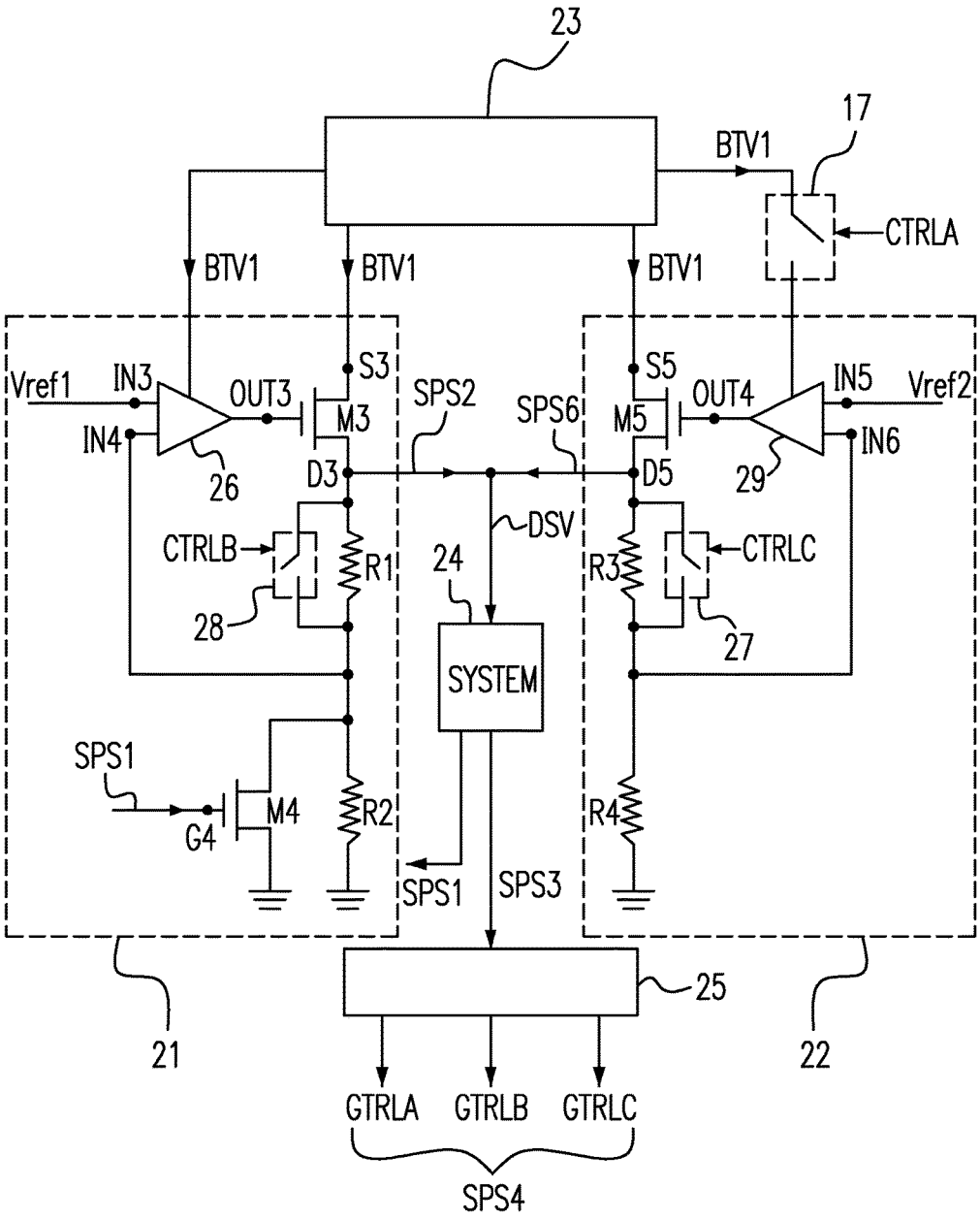
FIG. 7 shows LDO power circuits in detail according to the preferred embodiment of the present disclosure.

Please refer to FIG. 7, which shows the LDO power circuits 21 and 22 in detail according to the preferred embodiment of the present disclosure. The LDO power circuit 21 has a relatively low capacity to supply a light-load current to the system 24. The LDO power circuit 21 includes an amplifier 26, a power MOS unit M3, a first resistor R1, a second resistor R2 and a MOS switch M4. The amplifier 26 has a third and a fourth input terminals IN3 and IN4 and a third output terminal OUT3. The input terminal IN3 receives a reference voltage Vref1 which varies with the idle mode or the active mode. The power MOS unit M3 has a drain terminal D3 and is coupled to the amplifier 26 at the third output terminal OUT3, wherein the power MOS unit M3 receives the battery voltage BTV1 at a source terminal S3 of the power MOS unit M3. The first resistor R1 is electrically connected to the fourth input terminal IN4 and the drain terminal D3. The second resistor R2 is electrically connected to the fourth input terminal IN4 and a ground terminal GND. The MOS switch M4 has a gate terminal G4 and is electrically connected to the fourth input terminal IN4, and the gate terminal G4 receives the first power signal SPS1, wherein the first power signal SPS1 is a wake-up signal from the digital circuit 240. The LDO power circuit 22 include an amplifier 29, resistors R3 and R4, and a power MOS unit M5 having a drain terminal D5 and a source terminal S5, wherein the power MOS unit M5 receives the battery voltage BTV1 at the source terminal 55, and the drain terminals D4 and D5 are electrically connected without a switch. The structure of the LDO power circuit 22 is similar to that of the LDO power circuit 21, but the LDO power circuit 21 has an additional MOS switch M4. The amplifier 29 has input terminals IN5 and IN6 and an output terminal OUT4. The input terminal IN5 receives a reference voltage Vref2 which varies with the idle mode or the active mode. The resistor R3 is electrically connected to the input terminal IN6 and the drain terminal D5. The resistor R4 is electrically connected to the input terminal IN6 and the ground terminal GND.

In FIG. 7, the LDO power circuit 21 has a low capacity, provides a light load current to the system 24, and is directly supplied by the battery unit 23 without a switch whether in the idle mode or in the active mode because the LDO power circuit 22 consumes very little power. However, because the LDO power circuit 22 has a high capacity and provides a high load current to the system 24, it will consume more power. The switch 17 can control when the battery voltage BTV1 is supplied to the amplifier 29, but the switch 17 needs a high voltage to turn it on, and the level shift unit 25 can supply a control signal CTRLA having the fourth power level to drive the switch 17. The level shift unit 25 can also output control signals CTRLB and CTRLC having the fourth power level to control the switches 28 and 27 respectively. The control signal CTRLA is a key control signal to cause the switch 17 to conduct, so the LDO power circuit 22 can be activated and supply the system 14 with the sixth power signal SPS6 having the fifth power level. The control signals CTRLB and CTRLC can control the output voltage from drain terminals D3 and D5 respectively by adjusting the equivalent resistances r1 and r3 according to Equation 1.

In FIG. 7, when the NMOS unit M4 is cut off, the first resistor R1 has a first equivalent resistance r1, the second resistor R2 has a second equivalent resistance r2, the amplifier 26 receives the reference voltage Vref1 at the third input terminal IN3, the fourth input terminal IN4 has the reference voltage Vref1 because of a virtual ground between these two input terminals IN3 and IN4. The LDO power source 21 outputs the second power signal PSP2 at the drain terminal D1, the second power signal PSP2 has a first LDO output voltage VLDO1 that is equal to the following equation based on a divide voltage theorem:

$$VLDO1 = Vref1 \times \left(1 + \frac{r1}{r2}\right). \quad \text{(Equation 1)}$$

In Equation 1, the first LDO output voltage VLDO1 is equal to the second power level of the second power signal SPS2, and is output from the drain terminal D1 to the system 24. When the NMOS unit M4 conducts, the second equivalent resistance r2 will be reduced because there is a small internal resistance when the NMOS unit conducts. Thus, a new equivalent resistance equals the equivalent parallel resistance of the second equivalent resistance r2 and the small internal resistance. The new equivalent resistance is reduced dramatically, causing the first LDO output voltage VLDO1 to boost to a higher voltage that the level shift unit 25 can accept according the Equation 1.

Figure 8:
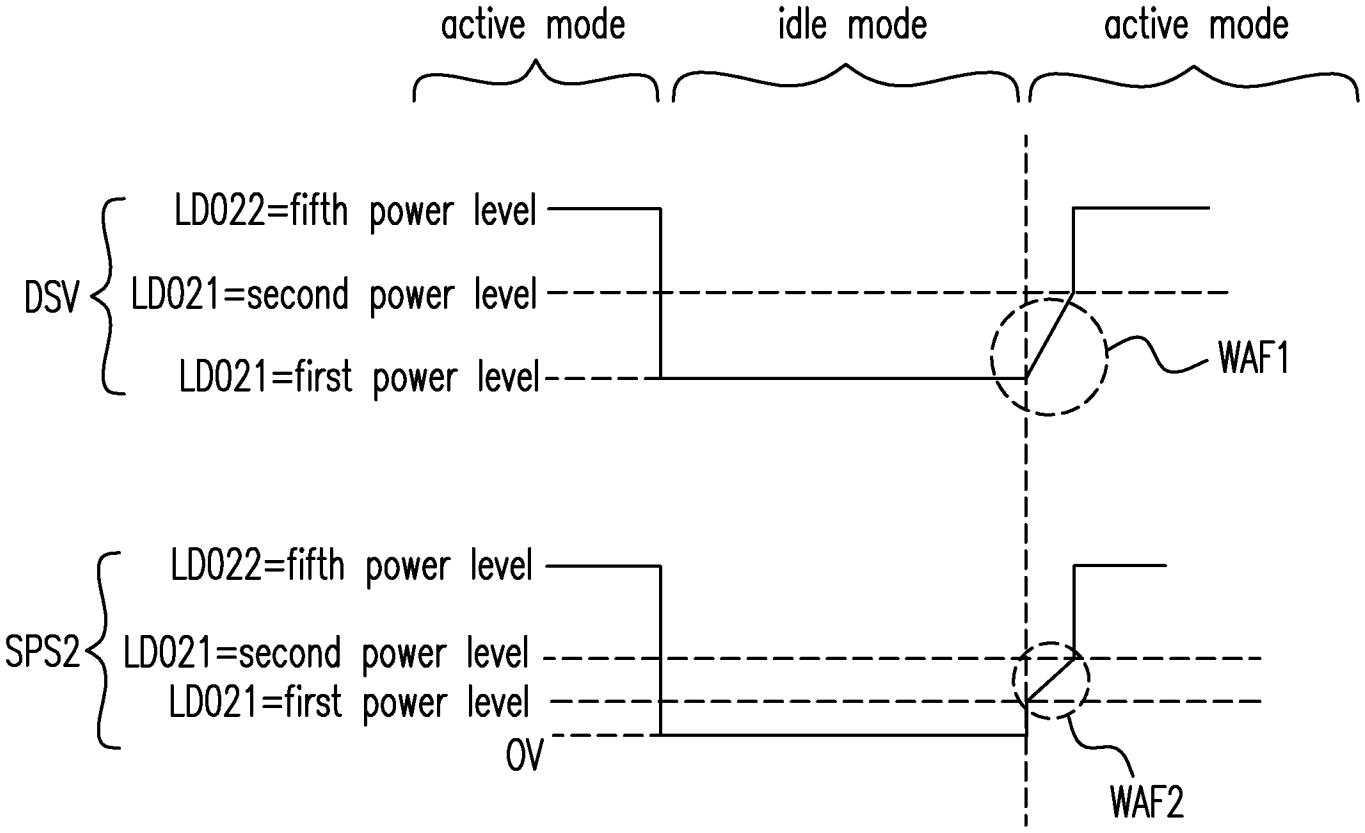
FIG. 8 shows waveforms of a digital supply voltage and a second power signal according the preferred embodiment of the present disclosure.

Please refer to FIG. 8, which shows waveforms of the digital supply voltage DSV and the second power signal SPS2 according the preferred embodiment of the present disclosure. The horizontal axis represents time, and the vertical axis represents a power level, for example a voltage level. Please refer to FIGS. 7 and 8, when the system 24 changes from the active mode to the idle mode, the digital supply voltage DSV supplied to the system 24 changes from the fifth power level to the first power level, for example, from 1.2 volts to 0.7 volt typically, which indicates that the LDO power circuit 22 is powered off and only the LDO power circuit 21 supplies the first power signal PSP1 to the system 24 in the idle mode. The system 24 outputs the second power signal SPS2 in response to the power level change, so the second power signal SPS2 drops its power level from the fifth power level to zero.

Please refer to FIGS. 7 and 8, the system 24 may be triggered by at least one of an interrupt event, an awaken event, a timer event, or an idle event. When the system 24 is awakened from the idle mode to the active mode, the NMOS unit M4 conducts to have the small internal resistance paralleled with the resistance r2 of the resistor R2, the second power level will be elevated according to the Equation. The LDO power circuit 21 boosts the second power signal PSP2 from the first power level to the second power level as shown in WAF1 and WAF2, for example, from 0.7 volt to 0.9 volts typically. In some embodiments, the system 24 can output the third power level which is the same as the second power level. The first power level is insufficient to drive the level shift unit 25, but the third power level can satisfy the demand to successfully drive the level shift unit 25. For example, the level shift unit 25 can accept the third power level range of 0.9-1.2 volts, and convert it into the fourth power signal SPS4 having 3.3 volts, and then the switch 17 can be turned on by the control signal CTRLA, and the LDO power circuit 22 is able to supply the sixth power signal SPS6 to the system 24 in the active mode.

In FIG. 7, the reference voltages Vref1 and Vref2 are generated from a band gap circuit (not shown) which is powered by the battery unit 23. When the system 24 enters the idle mode, the system 24 can control the band gap circuit to lower the reference voltage Vref1. For example, the reference voltage may be less than 0.7 volt to further save power depending on future requirements. When the system 24 enters the active mode, the system 24 can also control the band gap circuit to lower the reference voltage Vref2 to save power or to increase the reference voltage Vref2 to satisfy the load of the system 24. In some embodiments, when the system 24 operates from the idle mode to the active mode, the system 24 can also control the band gap circuit to increase the reference voltage Vref1, and thus it helps elevate the second power level of the second power signal SPS2 according the Equation 1.

Figure 9:
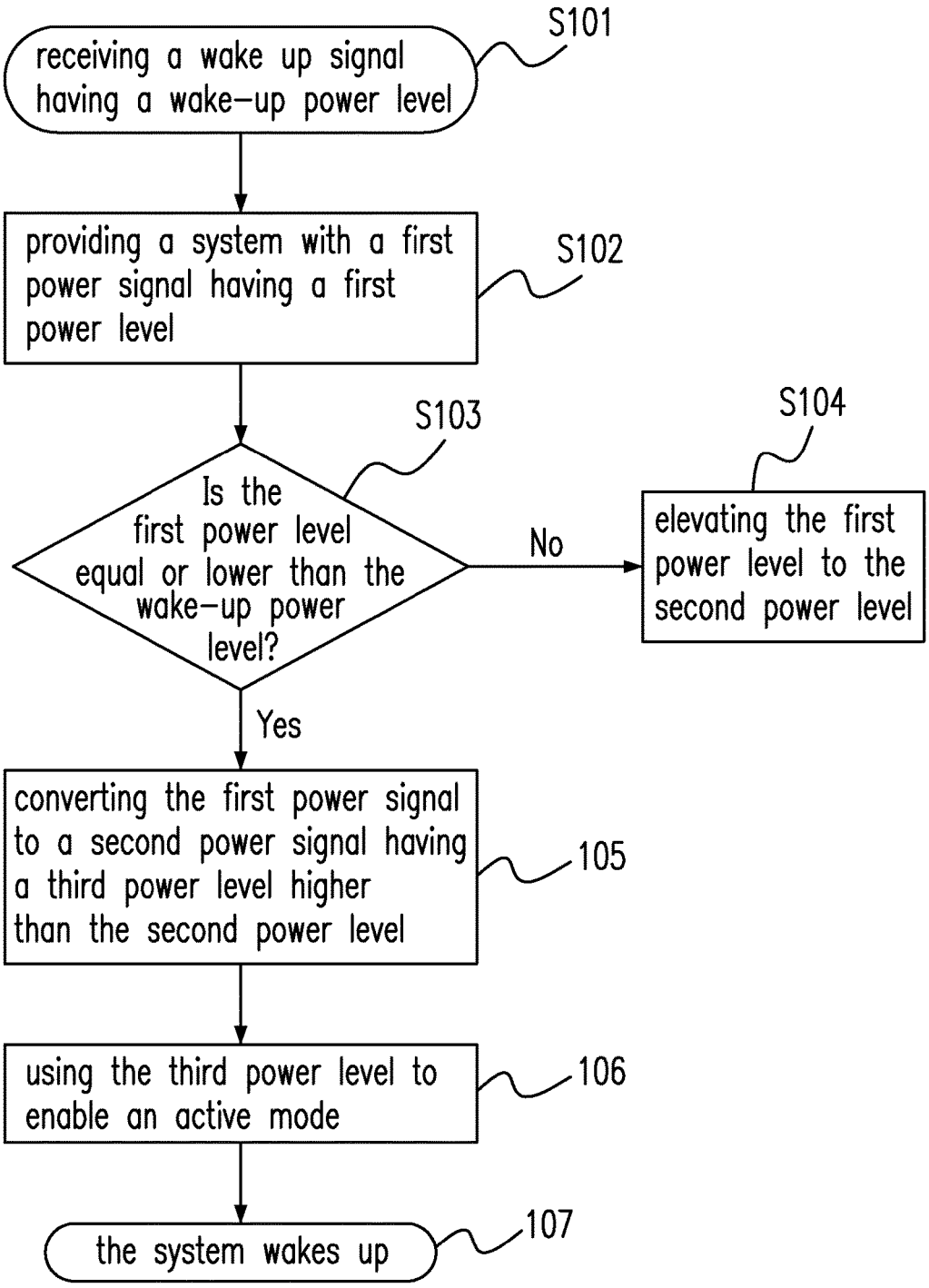
FIG. 9 shows a wake-up procedure of a system according the preferred embodiment of the present disclosure.

Please refer to FIG. 9, which shows a wake-up procedure of the system 24 according the preferred embodiment of the present disclosure. In step S101: receiving a wake-up signal having a wake-up power level. In step S102: providing a system with a first power signal having a first power level. In step S103: making a decision on whether the first power level is equal or lower than the wake-up power level. When the decision is negative, the wake-up procedure includes step S104; when the decision is positive, the wake-up procedure includes step S103. In step S104: elevating the first power level to the second power level. In step 105: converting the first power signal into a second power signal having a third power level higher than the second power level. In step S106: using the third power level to enable an active mode. In step S107: the system wakes up.

Embodiments

1. A level shifting module used with a digital circuit which generates a first power signal in an idle mode, comprises a first low drop-out (LDO) power circuit, a level shift unit and a second LDO power circuit. The LDO power circuit is electrically connected to the digital circuit, receives the first power signal having a first power level, and outputs a second power signal having a second power level to the digital circuit, wherein the second power level is higher than the first power level. The level shift unit is electrically connected to the digital circuit, receiving the second power signal, and outputs a third power signal, wherein the third power level has a third power level higher than the first power level, and the first power level is insufficient to allow the level shift unit to convert the first power level to the third power level. The second LDO power circuit is electrically connected to the first LDO power circuit and the digital circuit, and receives the third power signal to activate and power the digital circuit under an active mode.

2. The module in Embodiment 1, wherein the digital circuit outputs a fourth power signal having a fourth power level in response to receiving the second power signal, and the fourth power level is equal to the second power level. The first LDO power circuit and the second LDO power circuit respectively have two power output terminals electrically connected to the digital circuit.

3. The module of any one of Embodiments 1-2, wherein the first LDO power circuit operates when the digital circuit is under the idle mode, the second LDO power circuit operates when the digital circuit is under the active mode, and the third power signal has a voltage higher than that of the second power signal.

4. The module of any one of Embodiments 1-3, wherein the level shift unit includes a first inverter, a second inverter, a first n channel metal oxide semi-conductor (NMOS) unit and a second NMOS unit. The first inverter is powered by a battery unit, has a first input terminal and a first output terminal and outputs the fourth power signal. The second inverter is powered by the battery unit, and has a second input terminal and a second output terminal, wherein the first input terminal is electrically connected to the second output terminal and the first output terminal is electrically connected to the second input terminal. The first NMOS unit has a first drain terminal electrically connected to the first input terminal and has a first gate terminal receiving the third power signal. The second NMOS unit has a second drain terminal electrically connected to the second input terminal and has a second gate terminal receiving a fourth power signal, and has an opposite logic level compared to that of the third power signal.

5. The module of any one of Embodiments 1-4, wherein the first LDO power circuit includes an amplifier, a first power MOS unit, a first resistor, a second resistor and a MOS switch. The amplifier has a third and a fourth input terminals and a third output terminal. The first power MOS unit has a first drain terminal and a first source terminal, and is coupled to the amplifier at the third output terminal, wherein the first power MOS unit receives a battery voltage at the first source terminal. The first resistor is electrically connected to the fourth input terminal and the first drain terminal. The second resistor is electrically connected to the fourth input terminal and a ground terminal. The MOS switch has a gate terminal and is electrically connected to the fourth input terminal and receives the first power signal, wherein the first power signal is a wake-up signal from the digital circuit. The second LDO power circuit has a second power MOS unit which has a second drain terminal and a second source terminal, wherein the second power MOS unit receives the battery voltage at the second source terminal, and the first drain terminal and the second drain terminal are electrically connected to each other without a switch.

6. The module of any one of Embodiments 1-5, wherein the first resistor has a first equivalent resistance r1, the second resistor has a second equivalent resistance r2, the amplifier receives a reference voltage Vref at the third input terminal, the first LDO power source outputs the second power signal at the first drain terminal, the second power signal has a first LDO output voltage VLDO1 equal to the following equation based on a divide voltage theorem:

$$VLDO1 = Vref \times \left(1 + \frac{r1}{r2}\right).$$

7. The module of any one of Embodiments 1-6, wherein when the MOS switch receives the first power signal, the MOS switch conducts the fourth input terminal and the ground terminal, reducing the second equivalent resistance r2, and causing the first LDO output voltage VLDO1 to elevate to the second level.

8. A method of operating a level shifting module including a level shift unit, a first power circuit and a second power circuit used with a system, the method comprising steps of: upon receiving a wake-up signal having a wake-up power level from the system, providing the system with a first power signal having a first power level higher than the wake-up power level; generating a second power signal having a second power level in response to the first power signal; outputting a third power signal to activate the second power circuit under an active mode in response to the second power signal, wherein the wake-up power level is insufficient to drive the level shift unit, and the second power level is higher than the wake-up power level in order to drive the level shift unit.

9. The method in Embodiment 8, wherein the first power circuit includes a regulator and a loop-back portion, and the method further comprises: adjusting an equivalent impedance of the loop-back portion in response to the wake-up signal and a reference signal; and elevating the first power signal from the first power level to the second power level.

10. The method of any one of Embodiment 8-9, further comprising steps of: electrically connecting the first power circuit and the second power circuit in a switchless way; and electrically connecting the system to the first power circuit and the second power circuit simultaneously.

11. The method of any one of Embodiments 8-10, further comprising steps of: providing the system with a fourth power signal having a fourth power level to operate the system under an idle mode; activating the first power circuit and disabling the second power circuit when the system is under the idle mode; and activating the second power circuit and disabling the first power circuit when the first power level of the first power signal is elevated to have the second power level; providing the system with a fifth power signal having a fifth power level to operate the system under an active mode.

12. The method of any one of Embodiments 8-11, further comprising steps of: the level shift unit receiving a battery voltage to elevate the second power level to the third power level, wherein the level shift unit is a standard level shift unit.

13. The method of any one of Embodiments 8-12, wherein the first power circuit includes a regulator having a loop-back impedance and an impedance control unit further comprising steps of: enabling the impedance control unit to decrease the loop-back impedance; and elevating the first power level to the second power level due to the decreased loop-back impedance.

14. The method of any one of Embodiments 8-13, wherein the first power circuit includes a first regulator charged by a battery voltage through a first switch, the second power circuit includes a second regulator charged by the battery voltage through a second switch, and the method further comprises one of steps of: cutting off the first switch and conducting the second switch when the system is under the active mode; and conducting the first switch and cutting off the second switch when the system is under the idle mode.

15. A power circuit comprises a first regulator and an impedance adjustment unit. The first regulator has a loop-back impedance, and provides a first power signal. The impedance adjustment unit is coupled to the first regulator, and operates to cause the first regulator to provide a second power signal having a power level different from that of the first power signal.

16. The circuit in Embodiment 15, wherein the first regulator provides a core logic circuit with the first power signal. The impedance adjustment unit controls the loop-back impedance to elevate the power level. The power circuit is used with a level shift unit, and the level shift unit includes a first inverter, a second inverter, a first n channel metal oxide semi-conductor (NMOS) unit and a second NMOS unit. The first inverter is powered by a battery unit, has a first input terminal and a first output terminal, and outputs a control signal to control a second regulator. The second inverter is powered by the battery unit, has a second input terminal and a second output terminal, wherein the first input terminal is electrically connected to the second output terminal and the first output terminal is electrically connected to the second input terminal. The first NMOS unit has a first drain terminal electrically connected to the first input terminal, and a first gate terminal receiving the second power signal. The second NMOS unit has a second drain terminal electrically connected to the second input terminal, and a second gate terminal receiving a third power signal, wherein the third power signal has an opposite logic level compared to that of the second power signal.

17. The circuit of any one of Embodiments 15-16, wherein the first regulator is an LDO regulator and includes an amplifier, a power MOS unit, a first resistor and a second resistor. The amplifier has a third and a fourth input terminals and a third output terminal. The power MOS unit has a drain terminal and is coupled to the amplifier at the third output terminal. The first resistor is electrically connected to the fourth input terminal and the drain terminal. The second resistor is electrically connected to the fourth input terminal and a ground terminal.

18. The circuit of any one of Embodiments 15-17, wherein the impedance adjustment unit is a MOS switch, having a gate terminal and electrically connected to the fourth input terminal, and the gate terminal receives the first power signal, wherein the first power signal is a wake-up signal from the system.

19. The circuit of any one of Embodiments 15-18, wherein the first resistor has a first equivalent resistance r1, the second resistor has a second equivalent resistance r2, the amplifier receives a reference voltage Vref at the third input terminal, the first LDO power source outputs the second power signal at the drain terminal, and the second power signal has a first LDO output voltage VLDO1 equal to the following equation based on a divide voltage theorem:

$$VLDO1 = Vref \times \left(1 + \frac{r1}{r2}\right)$$

20. The circuit of any one of Embodiments 15-19, wherein when the MOS switch receives the first power signal, the MOS switch conducts from the fourth input terminal to the ground terminal, reducing the second equivalent resistance r2, and causing the first LDO output voltage VLDO1 to elevate to the second level.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A level shifting module used with a digital circuit which generates a first power signal in an idle mode, comprising:

a first low drop-out (LDO) power circuit electrically connected to the digital circuit, receiving the first power signal having a first power level, and outputting a second power signal having a second power level to the digital circuit, wherein the second power level is higher than the first power level;

a level shift unit electrically connected to the digital circuit, receiving the second power signal, and outputting a third power signal, wherein the third power level has a third power level higher than the first power level, and the first power level is insufficient to allow the level shift unit to convert the first power level to the third power level; and a second LDO power circuit electrically connected to the first LDO power circuit and the digital circuit, and receiving the third power signal to activate and power the digital circuit under an active mode.

2. The module as in claim 1, wherein:

the digital circuit outputs a fourth power signal having a fourth power level in response to receiving the second power signal, and the fourth power level is equal to the second power level; and the first LDO power circuit and the second LDO power circuit respectively have two power output terminals electrically connected to the digital circuit.

3. The module as in claim 1, wherein the first LDO power circuit operates when the digital circuit is under the idle mode, the second LDO power circuit operates when the digital circuit is under the active mode, and the third power signal has a voltage higher than that of the second power signal.

4. The module as in claim 1, wherein the level shift unit includes:

a first inverter powered by a battery unit, having a first input terminal and a first output terminal and outputting the fourth power signal;

a second inverter powered by the battery unit, and having a second input terminal and a second output terminal, wherein the first input terminal is electrically connected to the second output terminal, and the first output terminal is electrically connected to the second input terminal;

a first n channel metal oxide semi-conductor (NMOS) unit having a first drain terminal electrically connected to the first input terminal and having a first gate terminal receiving the third power signal; and a second NMOS unit having a second drain terminal electrically connected to the second input terminal and having a second gate terminal receiving a fourth power signal, and having an opposite logic level compared to that of the third power signal.

5. The module as in claim 1, wherein:

the first LDO power circuit includes:

an amplifier having a third and a fourth input terminals and a third output terminal;

a first power MOS unit having a first drain terminal and a first source terminal, and coupled to the amplifier at the third output terminal, wherein the first power MOS unit receives a battery voltage at the first source terminal;

a first resistor electrically connected to the fourth input terminal and the first drain terminal;

a second resistor electrically connected to the fourth input terminal and a ground terminal;

a MOS switch having a gate terminal and electrically connected to the fourth input terminal and receiving the first power signal, wherein the first power signal is a wake-up signal from the digital circuit; and the second LDO power circuit having a second power MOS unit which has a second drain terminal and a second source terminal, wherein the second power MOS unit receives the battery voltage at the second source terminal, and the first drain terminal and the second drain terminal are electrically connected to each other without a switch.

6. The module as in claim 5, wherein the first resistor has a first equivalent resistance r1, the second resistor has a second equivalent resistance r2, the amplifier receives a reference voltage Vref at the third input terminal, the first LDO power source outputs the second power signal at the first drain terminal, the second power signal has a first LDO output voltage VLDO1 equal to the following equation based on a divide voltage theorem:

$$VLDO1 = Vref \times \left(1 + \frac{r1}{r2}\right).$$

7. The module as in claim 6, wherein when the MOS switch receives the first power signal, the MOS switch conducts the fourth input terminal and the ground terminal, reducing the second equivalent resistance r2, and causing the first LDO output voltage VLDO1 to elevate to the second level.

* * * * *